United States Patent [19]

Lowe

[11] Patent Number: 4,648,121

[45] Date of Patent: Mar. 3, 1987

[54] TWO LAYER PACK STRUCTURE WITH OFFSET SEAMS

[75] Inventor: Greg E. Lowe, Ogden, Utah

[73] Assignee: Lowe Alpine Systems, Inc., Lafayette, Colo.

[21] Appl. No.: 257,692

[22] Filed: Apr. 27, 1981

[51] Int. Cl.[4] ..... A45F 3/04; B65D 30/08; B65D 33/16

[52] U.S. Cl. ..... 383/76; 383/86; 383/107; 383/109; 383/113; 224/209; 224/259

[58] Field of Search ..... 150/1, 11, 2.1, 3, 28 A, 150/104, 105; 224/153, 209, 215; 229/53; 383/72, 76, 86, 86.1, 111, 113, 122, 107, 108, 109

[56] References Cited

U.S. PATENT DOCUMENTS

| | | | |
|---|---|---|---|
| 2,013,358 | 9/1935 | Osborne | 150/1 |
| 3,998,304 | 12/1976 | Edgerton, Jr. et al. | 150/3 X |
| 4,213,549 | 7/1980 | Hibbard | 224/209 |

FOREIGN PATENT DOCUMENTS

| | | | |
|---|---|---|---|
| 61245 | 8/1939 | Norway | 224/209 |
| 70732 | 7/1946 | Norway | 224/209 |
| 11081 | of 1908 | United Kingdom | 150/11 |

OTHER PUBLICATIONS

"65–66 Winter edition, Gerry Mountain Climbing & Camping Equipment", p. 22 (Climbing Pack) 1/6/1966.

*Primary Examiner*—William Price
*Assistant Examiner*—Sue A. Weaver
*Attorney, Agent, or Firm*—Thomas W. O'Rourke

[57] ABSTRACT

A backpack or transport bag including an outer pack structure of pliable material, preferably treated on one side with a water resistant coating, and including a number of seams or other perforations therethrough to attach straps, pockets, etc., the outer pack structure including closure means to close an opening defined therein, and an inner bag structure of a shape complementary to the outer pack structure and also of a pliable material coated on one side thereof with a water resistant material, the inner bag means including complementary upper closure means to attach to and function with the closure means of the outer pack, the inner bag and the outer pack preferably having seams at differing locations.

9 Claims, 2 Drawing Figures

TWO LAYER PACK STRUCTURE WITH OFFSET SEAMS

BACKGROUND OF THE INVENTION

1. Field of the Invention

The present invention relates generally to soft pack structures such as stuffsacks, backpacks or rucksacks adapted to contain articles for transport, and more particularly to a soft pack structure having enhanced integrity against water infiltration, the structure including a substantially conventional outer pack structure of pliable water resistant material having an opening defined therein and means to close and cover such pliable opening, and an inner bag structure also of water resistant, pliable material adapted to fit within the outer pack structure and cooperate with the closure means of the upper outer pack structure to facilitate attachment of the inner bag structure to the outer pack structure and provide for concurrent closure of both.

2. Description of the Prior Art

Soft pack structures such as backpacks, stuffsacks, rucksacks etc. are of course well known. The better quality of such packs are formed of wear resistant, woven material coated on one side therewith with a substantially water impervious material, typically a nylon or polyester cloth coated on one side with a urethane material to resist water penetration. In many instances, such packs are utilized to carry clothing, food stuffs, equipment etc. critical to the very survival of the user. Heretofore such pack structures have provided only limited resistance to moisture penetration under adverse conditions, i.e., rain, wet snow, water spray etc. While the materials from which the pack structures are constructed are in fact highly water resistant as a result of coatings such as the urethane coatings, the water resistant integrity of such structures is severely compromised by the many perforations in typical pack structures, i.e., for seams to form the pack structure itself, and to attach panels, bottoms, shoulder straps, pockets, holding loops, and various other sewn constructions and features. While the synthetic materials and water resistant coatings thereon are highly resistant to water penetration, such materials are not self healing around perforations. Thus water readily infiltrates through the many needle and other holes formed in the pack structure as an unavoidable result of conventional production of such pack structures.

To combat the serious threat of wetting of the contents of the pack structure, it has heretofore been the practice to wrap the separate, or entire, contents of the sack in individual waterproof enclosures, such as polymer film bags commonly employed as "garbage" bags. Such efforts, while inconvenient, are often effective. However, in the instance of film enclosures, during the course of an extended expedition, it is not unusual for the polymer film bags to become ripped and perforated.

It has also been customary to line certain pack bags with a second layer of material to decrease water penetration through the coated surfaces. However, this type of construction does not diminish total seams (and subsequent reduced needle hole water penetration) since the lining is simply a mirror image of the outer material layers and has identical seam placement and number as the outer material layer.

SUMMARY OF THE INVENTION

The present invention, which provides a heretofore unavailable improvement over soft previous pack structures with regard to protection of the contents thereof against water infiltration comprises a substantially conventional outer soft pack structure preferably including an opening defined therein and including means to close and cover the opening, preferably flap means to protect the opening from water, such as rain. In addition, a complementary inner bag structure of a water resistant material, i.e., a woven synthetic or other bag material coated on one side with a water proof coating, positioned within the outer bag structure, with the upper portion thereof cooperating with the closure means of the outer bag structure to both secure the inner bag structure therein and provide for concurrent opening and closure of both the inner and outer bag structures. Preferably the outer bag structure is coated with water resistant material on the inner surface thereof, and the inner bag structure is coated on the outer surface thereof to isolate water infiltrating the outer bag structure from the interior of the inner bag stucture.

Accordingly, an object of the present invention is to provide a new and improved soft bag structure which provides for convenient and reliable protection against water infiltration of the bag structure.

Another object of the present invention is to provide a new and improved soft bag structure which may be packed and used as conveniently as a conventional bag structure.

Yet another object of the present invention is to provide a new and improved soft bag structure which provides reliable protection against water infiltration over prolonged use.

Still another object of the present invention is to provide a new and improved soft bag structure which may be simply and economically produced and used.

Still yet another object of the present invention is to provide a new and improved soft bag structure which permits the simple and economical replacement of the inner bag structure when worn or wet.

These and other objects and features of the present invention will become apparent from the following description.

DETAILED DESCRIPTION OF THE INVENTION

Figure 1:
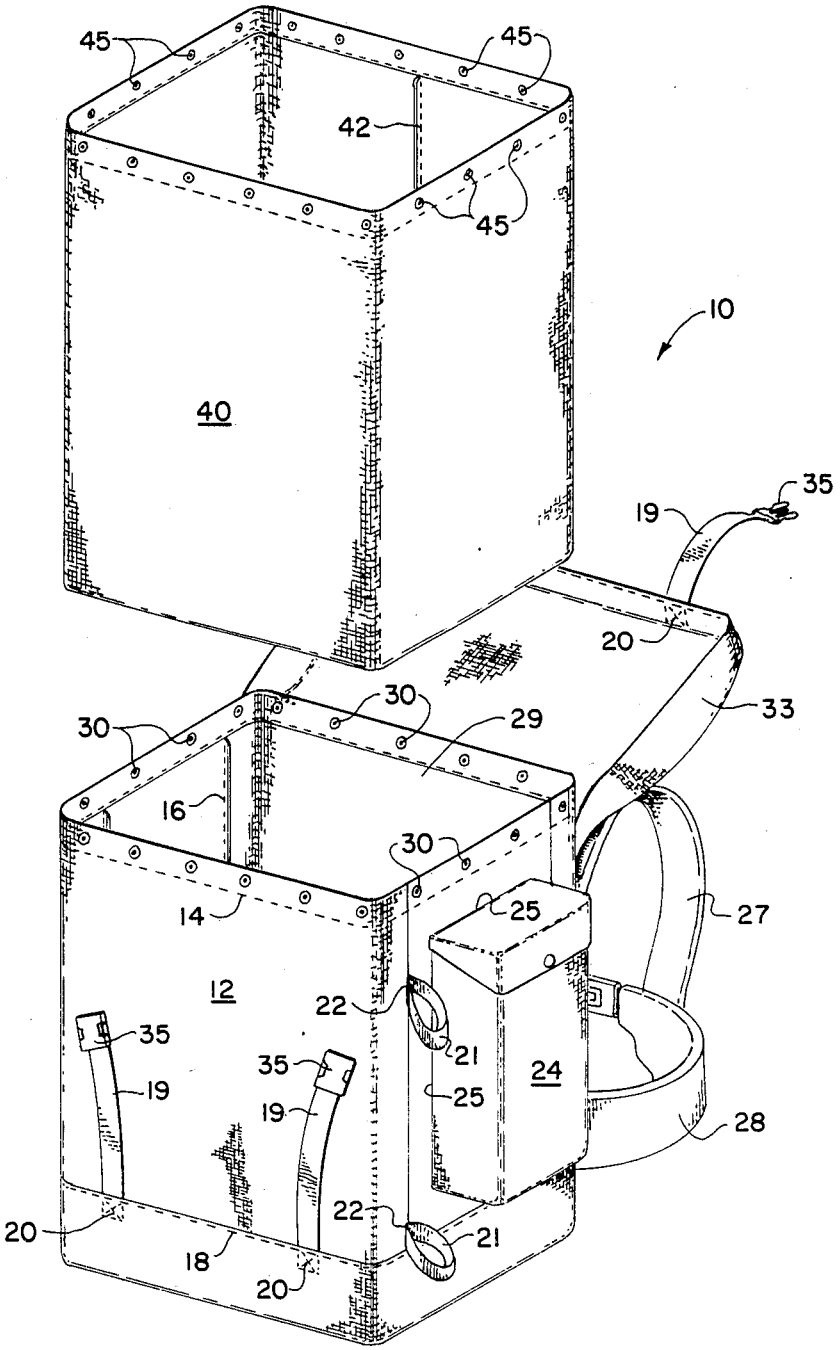
FIG. 1 is a perspective, expanded view of a soft bag structure in accord with the instant invention illustrating the inner and outer bag structures in a removed relationship.

Turning now to the drawings, wherein like components are designated by like reference numerals throughout the various figures, a pack structure in accord with the instant invention is illustrated in FIG. 1 and generally designated by the reference numeral 10. Pack structure 10 includes an outer pack structure 12, which is of substantially conventional construction. Outer pack structure 12 is, as is conventional, formed of a fabric conventionally used to construct packs, i.e., a nylon cloth coated with a urethane water resistant coating. Such material is itself abrasion resistant and highly resistant to water penetration. However, as illustrated, outer pack structure 12 includes a number of seams, i.e., 14, 16 and 18, a number of straps 19 sewn thereto at, for instance, positions 20, accessory loops 21 sewn at positions 22 and exterior pocket 24 sewn at, for instance, positions 25. Other typical sewn attachments, not specifically illustrated, include shoulder straps 27, waist belt 28, cross harness, compression straps, ski pockets etc. These many structural features seriously compromise the water resistance of outer pack structure 12, and require a complicated and expensive component.

Outer pack structure 12 includes at the upper portion thereof an opening 29 defined therein and a plurality of spaced grommets 30 adapted to received a drawstring to close opening 29 at the upper portion of outer pack structure 12. Flap 33, in turn, is adapted to fit over the upper portion of outer bag structure 12, and be secured by mating buckles 35. Thus, as discussed heretofore, though outer pack stucture 12 is produced of essentially water proof material, the many seams and attachment points for accessory loops, compression straps, etc. require that the integrity of the structure be substantially compromised by many needle perforations with accompanying potential for water leakage.

Accordingly, a much simpler inner bag structure 40 is provided of a shape complementary to that of outer pack structure 12 and adapted to fit within outer pack structure 12. Inner bag structure 40 is preferably produced of a similar material to that of outer pack structure 12, and preferably the water proof coating on outer pack structure 12 is on the inner side thereof, and the waterproof coating of inner bag stucture 40 is on the outer surface thereof. Further, though inner bag structure 40 may include limited seams 42, such seams 42 are preferably positioned so as to be remote from seams 14, 16 and 18 of outer pack structure 12, or transverse to seam 18 of outer pack structure 12 as is seam 42, as well as spaced from portions of outer pack structure 12 having substantial sewn areas. Seams of outer pack structure 12 and inner bag structure 40 are functionally transverse when intersecting at angles between about 45° and 135°. In the example illustrated, grommets 45 are provided at the upper portion of inner bag structure 40 and spaced in a manner complimentary to grommets 30 provided through the upper portion of outer pack structure 12.

Figure 2:
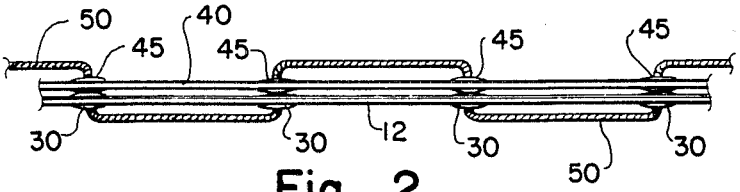
FIG. 2 is a sectional view of a preferred interface between the inner and outer bag structures of FIG. 1 at the closure portions thereof.

With reference to FIG. 2, it will be seen that a draw cord 50 may be positioned through adjacent grommets 30 and 45. Accordingly, outer pack structure 12 will be aligned with adjacent inner bag structure 40 and secured thereto by drawstring 50. In this simple manner, inner bag structure 40 may be easily and securely positioned within outer pack structure 12, closed concurrently with outer pack structure 12 by pulling on drawstring 50, but easily removeable from outer pack structure 12 for replacement or airing and drying, as well as inconspicuous in normal use. The waterproof interface between the adjacent surfaces of outer pack structure 12 and inner bag structure 40 substantially preclude infiltration of water to the interior of inner bag structure 40. What water passes through the many needle holes in outer pack structure 12 merely collects on the substantially unbroken outer waterproof surface of inner bag structure 40, and tends to be contained at the interface therebetween. Even when used for extensive periods of time, little detrimental wear will occur to the protected waterproof surfaces, thus providing reliability of bag structure 10. However, should wear occur, the simple and economical inner bag structure 40 may be easily replaced.

In summary, the instant invention addresses the long standing problem of protecting the contents of a soft pack structure which, though of waterproof material, necessarily includes a great many needle or other perforations as a result of construction of the pack. A simple, lightweight inner bag is provided in such a manner that it functions integrally with the outer pack while providing great integrity against water infiltration. While a particularly preferred securing means between the inner and outer bag structures is disclosed, i.e., an interlaced drawstring for simple attachment and closure of the pack and bag structure, it will be appreciated that other attachment means, including releasable fasteners, Velcro etc. may be employed between the upper portions of the two structures. Thus by attachment of the inner bag structure adjacent the outer pack structure opening, concurrent opening and closing of the two structures will result. While of particular utility with various backpacks, the concept may be employed with other soft bags including stuff sacks. Since the simple inner bag requires few seams and provides the better barrier against water, a worn pack can be largely rejuvenated against water leakage by the simple and economical replacement of the inner bag structure.

Although only several embodiments of the present invention have been illustrated and described, it is anticipated that various changes and modifications will be apparent to those skilled in the art, and that such changes may be made without departing from the scope of the invention as defined by the following claims.

What is claimed is:

1. A transport pack structure comprisinig:

an outer pack structure of water resistant pliable material having a plurality of structural and attachment sewn seams therein;

an opening defined in the outer pack structure;

an inner bag structure of a shape complimentary to the outer pack structure formed of a water resistant pliable material having seam perforations defined therethrough and positioned within the outer pack structure with the seam perforations spaced from the outer pack structure seams;

an opening defined in the inner bag structure at a position corresponding to the opening defined in the outer pack structure;

means positioned at the locations of the outer pack structure and inner bag structure openings to secure the inner bag structure within the outer pack structure; and means to concurrently close the openings defined in the outer pack structure and inner bag structure;

whereby the inner bag structure may function with the outer pack structure for purposes of sealing the closing while substantially enhancing the water protection of the interior as a result of the composite of the outer pack structure and inner bag structure.

2. A pack structure as set forth in claim 1 in which the water resistant outer pack structure and inner bag structure are each formed of a textile material having a waterproof coating thereon, and in which the waterproof coatings of each structure are positioned in an adjacent, face to face relationship.

3. A pack structure as set forth in claim 1 in which the inner bag structure includes spaced and intersecting seams in which intersecting seams of the outer pack structure and the inner bag structure cross at angles between 45° and 135°.

4. A pack structure as set forth in claim 1 in which the means to secure the inner bag structure within the outer pack structure comprise a plurality of grommet openings defined in both structures adjacent the openings of each, and a drawstring laced through both the grommet openings of the inner bag structure and such openings in the outer pack structure to provide both attachment and concurrent closure of the inner bag structure and the outer pack structure.

5. A pack structure as set forth in claim 1 in which the outer pack structure includes at least one of sewn seams for straps, pockets, belts, flaps and such sewn seams are adjacent substantially unbroken, seam-free areas on the inner bag structure.

6. A pack structure as set forth in claim 5 in which the seams of the outer pack structure cross seams on the inner bag structure at an angle greater than 45° and less than 135°.

7. A pack structure as set forth in claim 1 in which the outer pack structure and inner bag structure are attached together only at the positions adjacent the openings defined in the outer pack structure and the inner bag structure.

8. A backpack having an improved water resistance at the interior portion thereof, the pack structure comprising:

an outer pack structure of water resistant pliable material in the form of a textile material having a waterproof coating thereon and a plurality of sewn seams therein piercing the waterproof coating;

an openinbg defined in the outer pack structure at an end portion thereof;

an inner bag structure formed of a water resistant pliable material having seams sewn therein and in the form of a textile material having a waterproof coating thereon, the inner bag structure being in a shape congruent with the outer pack structure shape and positioned within the outer pack structure with the waterproof coatings of the outer pack structure and inner bag structure in a face to face relationship with outer pack structure seams adjacent areas of the inner bag structure which are substantially unbroken by seams;

an opening defined in the inner bag structure at a position corresponding to and aligning with the opening defined in the outer pack structure;

cooperative means positioned at the outer pack structure opening the inner bag structure opening to secure the inner bag structure within the outer pack structure; and means to concurrently close the outer pack structure opening the inner bag structure opening.

9. A backpack structure as set forth in claim 8 in which the means to secure and close the outer pack structure and inner bag structure comprise a plurality of grommet openings circumferentially defined through each of the outer pack structure and inner bag structure at equally spaced positions adjacent the openings of the outer pack structure and inner bag structure, and drawstring means threaded through adjacent grommets in the outer pack structure and inner bag structure, such drawstring means comprising the sole connection between the outer pack structure and inner bag structure.

* * * * *